US005676375A

United States Patent [19]

Pirouzkhah

[11] Patent Number: 5,676,375

[45] Date of Patent: Oct. 14, 1997

[54] CARD AND DICE GAME

[76] Inventor: Alireza Pirouzkhah, P. O. Box 40554, Downey, Calif. 90239

[21] Appl. No.: 767,230

[22] Filed: Dec. 13, 1996

Related U.S. Application Data

[63] Continuation-in-part of Ser. No. 488,174, Aug. 31, 1995.

[51] Int. Cl.[6] ..... A63F 3/00

[52] U.S. Cl. ..... 273/274; 273/292

[58] Field of Search ..... 273/274, 292, 273/309, 146, 85 CP, 85 G

[56] References Cited

U.S. PATENT DOCUMENTS

| | | | |
|---|---|---|---|
| 4,643,431 | 2/1987 | Hilinsky | 273/243 |
| 4,746,126 | 5/1988 | Angileri | 273/274 |
| 5,314,193 | 5/1994 | Ferrer | 273/274 |

*Primary Examiner*—William M. Pierce
*Attorney, Agent, or Firm*—Charles H. Thomas

[57] ABSTRACT

A combination card and dice game is employed suitable for play in casinos and card clubs. A number of players are seated around a table and one of the players is designated as a bank player. All other players thereupon become nonbank players. All players make their wagers prior to dealing of any cards. Two poker deck cards are thereupon dealt face down to all players. While the nonbank players may immediately look at their cards, the bank player's cards must remain face down until the bank player rolls a pair of cubical gambling dice to determine a current target point count. These dice are preferably specially configured so that they will display either a total of seven or eleven spots, regardless of the faces of the dice showing. Therefore, the target point count for each game is either the number seven or the number eleven. Players determine the values of their hands and may optionally draw a third card. The object of the game is to achieve a hand value as close as possible to the target point count of seven or eleven. If the point count total within a hand exceeds the target point count, whole number integer multiples of the target point count are subtracted from the total point count until a number equal to or less than the target point count is reached.

17 Claims, 5 Drawing Sheets

CARD AND DICE GAME

BACKGROUND OF THE INVENTION

The present application is a continuation in part of U.S. application Ser. No. 488,174, filed Aug. 31, 1995, presently pending.

1. Field of the Invention

The present invention is in the field of games of chance and is a combination card and dice game played in card clubs and casinos for money wagering. The present invention simulates the excitement of a crap game but avoids the complicated rules of craps and also incorporates the challenges of strategic card play.

2. Description of the Prior Art

Casino gambling is widely regulated in most jurisdictions. A few states allow a wide range of casino gambling, while some others permit a limited range of games to be played for money wagers in licensed casinos. The state of California is an example of the latter case. In states that permit a limited range of games, the players are legally prohibited from playing against the casino. The most widely played card game in such jurisdictions is poker.

In the state of California, for example, there are state laws that establish basic rules for a game to be played legally. According to such a legal gaming format: 1) The house never participates as a player or banker. 2) The house never takes a percentage of the wagers. 3) The bank players are never required to cover all the opposing players' wagers. Moreover, games must meet the required proscriptions of local ordinances as well. Such games must meet the requirements of Penal Code Sections 319 and 330 for lawful play in Card Club in Los Angeles County, for example.

Traditional games of craps, like those played in Nevada, use standard dice as a gaming device. In California, for example, the use of dice is more limited. In the state of California the games of Pai Cow Poker, California Baccarat, and Pan 9, use dice to denote where the deal in a round of play begins.

A need exists for new games suitable for play in gaming establishments licensed under state laws that permit only limited gaming, such as in California, in order to enhance the variety of games available to players in such jurisdictions. This need may be met by the creation of a card-and-dice combination-type game. Such a new game should not only comply with legal requirements, but should also be of a nature which provides an attractive financial return to the casino. Since the casino can only collect a collection, the revenue to the casino is improved with quick turnovers of the hands. In other words, the faster money changes hands at the card table, the more revenue is generated for the casino. This calls for a game where each hand is played quickly, without lengthy deliberation by the players.

SUMMARY OF THE INVENTION

The existing need for a new type of wagering game that can be played legally in jurisdictions that allow only limited gaming is provided by the present invention which uses the well established target numbers in the game of craps, namely the numbers 7 and 11, but in the context of a card game that can be played in jurisdictions of limited legal gaming.

The play of the present invention is greatly facilitated by the use of a table layout upon which indicia are printed indicative not only of player positions, but also the assessment of the values of the possible hands which may be dealt to the players. Also, the game of the invention includes a set of cubical gambling dice, but of very special configuration. Specifically, in one embodiment of the invention a pair of dice are employed which have spots on their square faces that in combination can display only a total of 7 or 11. The numerical dice combinations of 7 or 11 are equally distributed with a fifty percent chance to obtain either number as a target or optimum point count. The game of the present invention employs these specialized dice as in integral part of the game format.

The game of the invention conforms to gaming license requirements in jurisdictions of limited gaming so as to meet the proscriptions thereof for legal gaming. The specialized dice are employed in conjunction with cards selected from conventional 52-card poker decks. Specifically, in a preferred embodiment of the invention the game is played with at least seven conventional decks of poker cards, from which all the eights and nines have been removed. Since a conventional poker deck employs fifty-two cards, the removal of eights and nines from seven poker decks leaves three hundred eight cards for play. These cards are normally packed in a device called a shoe, which is well known throughout the gaming industry.

As in conventional casinos and card clubs, a dealer is employed by the establishment within which the game is conducted to collect and distribute wagers and to deal the cards. The dealer is not a player in the game, however. To the contrary, one of the players is designated as a banker, the rest of the players thereupon becoming nonbank players. Preferably, a banker button or marker is provided and is positioned in front of the player designated as the banker for each hand so that no confusion as to the identity of the player serving as the banker is likely to arise.

To select the banker, the banker button is passed clockwise among the players after each hand. Each player, upon receiving the banker button, has the option of becoming the banker for the next hand. Alternatively, that player may pass the button clockwise to the next player. Once a player elects to become the banker, the banker button remains in front of that player for the duration of that hand.

Once a player has been selected as the bank player, all other players are considered nonbank players. All players, including the bank player, then place their wagers. The establishment conducting the game receives a predetermined, set amount from each player participating in the game. The predetermined amount of each player's wager is then collected by a dealer who supervises the conduct of the game.

An option/action button is also preferably provided and is positioned in front of the player at the clockwise position immediately adjacent to the banker. The option/action button is indicative of the first position for election as to whether or not to receive an additional card, and the first position to receive cards in each round of dealing.

The dealer then deals two cards face down clockwise to all players starting with the player at the option/action position. While the nonbank players may look at their cards upon receipt, the bank player may not do so until a target point count is determined.

After all players, including the bank player, are dealt two cards, the bank player rolls a set of special dice. These dice are not the normal casino gambling dice, but to the contrary are configured so that whenever they are rolled together the sum total of spots displayed will always be either 7 or 11.

The throw of the dice determines a current target point count. The target point count will always be either 7 or 11. A marker with 7 on one side and 11 on the other side is provided at the gaming table. Once the bank player has thrown the dice the marker is turned so that the number 7 or 11, corresponding to the spots displayed in the throw of the dice, is turned up and displayed on the gaming table. This marker indicates the current target point count for that hand.

Each player is then give the option of playing the two cards originally dealt or drawing an additional card. The election in this regard commences with the player at the option/action position, as indicated by the option/action button. The same decision is made by each player, proceeding in a clockwise direction. To each player electing to receive a single additional card, the dealer deals an additional card to that player, face down.

Following the throw of the dice to establish a current target point, the bank player may look at his or her cards. The bank player is the last player to make a decision as to whether or not to receive an additional card. However, sometimes the bank player may be dealt cards totaling the alternative target point, namely the number 7 or 11, which did not appear in the roll of the dice. This is considered to be a craps hand, and the bank player is forced to receive an additional card and has no election in this regard in such a situation. All of the nonbank players, however, are given the option of playing the two cards of the hand originally dealt or drawing an additional card irrespective of the point count of the cards originally dealt.

All of the cards of all of the hands of all players are then turned face up and a determination is made by the dealer to identify winning and losing card hands according to several rules. Specifically, the total sum point count of cards held by each player is compared with the current target point count established by the throw of the dice. If the sum point count of cards held in a hand is greater than the target point count, a number equal to the target point count is iteratively subtracted from the total sum point count of cards held by each player until a number no greater than the current target point is reached. This number is then designated as the player's hand value. The value of a player's hand can never be equal to zero and the optimum hand is equal to the target point count, namely either 7 or 11, whichever of these two numbers was shown when the dice were thrown.

A player must stand on a hand in which the first two cards dealt are equal to the target point count, or some whole integer multiple thereof. That is, if a player is dealt cards totaling the target point count, or an integer multiple thereof, that player cannot elect to receive an additional card. Any player who does so automatically becomes a losing player.

If, in the initial round of dealing, a nonbank player's hand value is equal to the alternative target point count of seven or eleven which was not rolled and is not the current target point count, that player's hand may be treated as a craps hand. Nonbank players do have the option of standing on a craps hand that appears in the two cards dealt in the initial round of dealing. This results in a "push" with respect to the bank player, regardless of the hand value of the bank player. In a "push" situation a player neither collects nor pays any portion of his or her wager to the bank player. As previously noted, a bank player may not stand pat on a craps hand, but must receive an additional card.

The game is player with at least one standard fifty-two card poker deck in which the cards are assigned different point values of between one and ten inclusive. An ace has a value of one while numerically numbered cards have the values indicated thereon. All face cards have a point value of ten. In the preferred manner of play of the game, all eights and nines are removed from the deck or decks employed.

To win the game the hand value of a nonbank player's hand must be closer to the target point count, either 7 or 11, than the hand value of the bank player's hand. If a bank player's hand and a nonbank player's hand have the same hand value, a "push" situation exists, and no money is exchanged between these two players. In one broad aspect the present invention may be considered to be a method of playing a card and dice game among a plurality of nonbank players playing against a single bank player with the ultimate game objective of achieving a variable target point count.

The game is comprised of the following steps: providing a set of cubical gambling dice; providing a least one poker deck of a multiplicity of cards having different point values of between one and ten inclusive, wherein each of the cards has a specific one of the point values; placing a required wager within predetermined upper and lower limits by each of the players; and providing a dealer to collect a predetermined amount of each wager, to deal the cards, and to declare winners from among the players.

The game includes the further steps of: selecting one of the players as a bank player for each hand, all other of the players thereupon becoming nonbank players; collecting by the dealer of the predetermined amount of the required wager from each player; selecting one of the nonbank players as a starting position player; dealing by the dealer of a first round of two cards face down to each of the players in rotation beginning with the starting position player; throwing the dice to determine a current target point count, whereupon the players look at the faces of their cards to assess the values thereof toward achieving the target point count; determining by each player whether to draw a single additional card; dealing by the dealer of a second round of cards of no more than a single additional card to each player in rotation that requests a single additional card; and turning over all face down cards of each player.

The game is further comprised of the additional steps of: adding of the total sum point of cards held by each player; comparing the total sum point count of cards held by each player with the current target point count, and iteratively subtracting the target point count from the total sum point count of cards held by each player until a number no greater than the current target point count is reached, which number is then designated as the player's hand value; comparing the hand values of cards held by each nonbank player with the hand value of cards held by the bank player; declaring by the dealer as winning nonbank players all nonbank players whose hand values exceed the hand value of the bank player, and declaring by the dealer as losing nonbank players all nonbank players whose hand values are less than the hand value of the bank player; and paying by the bank player to winning nonbank players their respective wagers, less the aforesaid predetermined amount thereof previously collected by the dealer, and collecting by the bank player from losing nonbank players their respective wagers, less the predetermined amount thereof previously collected by the dealer.

The game is preferably played with the provision of a plurality of poker decks from which all eights and nines have been removed, and wherein all face cards are assigned a point value of ten and aces a point value of one. Preferably, between seven and eleven such decks are utilized. These decks, once stripped of their eights and nines, are then shuffled together and placed in a shoe from which the cards are drawn.

Preferably also the gambling dice are configured so as to display alternatively spots totalling only one of the two numbers 7 and 11 as the target point count. The pair of special dice employed are configured so that the first die has 5 spots on each of its six faces. The second die has 6 spots on each of three of its faces and 2 spots on each of its other three faces. Therefore, a target point of 7 or 11 is guaranteed with equal probability to show with each roll.

The game may be played with various modifications. For example, the game may be played with two sets of special dice. The first set of dice has previously been described. The second set of special dice employ two different die, one of which has 6 spots on each of four faces and 2 spots on the other two faces. The other die has 5 spots on four of its faces and 1 spot on two of its faces. As a consequence, only the numbers 7, 11, or 3, alternatively, can be rolled with this second pair of special dice.

In the modification of the invention employing the second pair of special dice, the second pair of dice is always thrown first. If the second pair of dice are rolled so that 2 spots on one of the die and 1 spot on the other of the die are showing, the bank player has the option of declaring the target point count as being 7 or 11. Alternatively, the bank player may instead roll the first pair of special dice, which will produce a target point count of only one or the other of the numbers 7 and 11.

In this modification of the invention, if a nonbank player's first two cards are an ace and a deuce and the second pair special dice are rolled to produce a craps count of one and two, totalling 3, a nonbank player holding an ace and a deuce has the option of playing the hand as a craps hand. This results in a "push" with the bank player, in which case neither the bank player nor the nonbank player holding the craps hand win. Alternatively, the player holding the craps hand with a point count of 3 may draw an additional card in the second round.

The game of the invention may be described with greater clarity and particularity by reference to the accompanying drawings.

DESCRIPTION OF THE IMPLEMENTATION OF THE INVENTION

Figure 1:
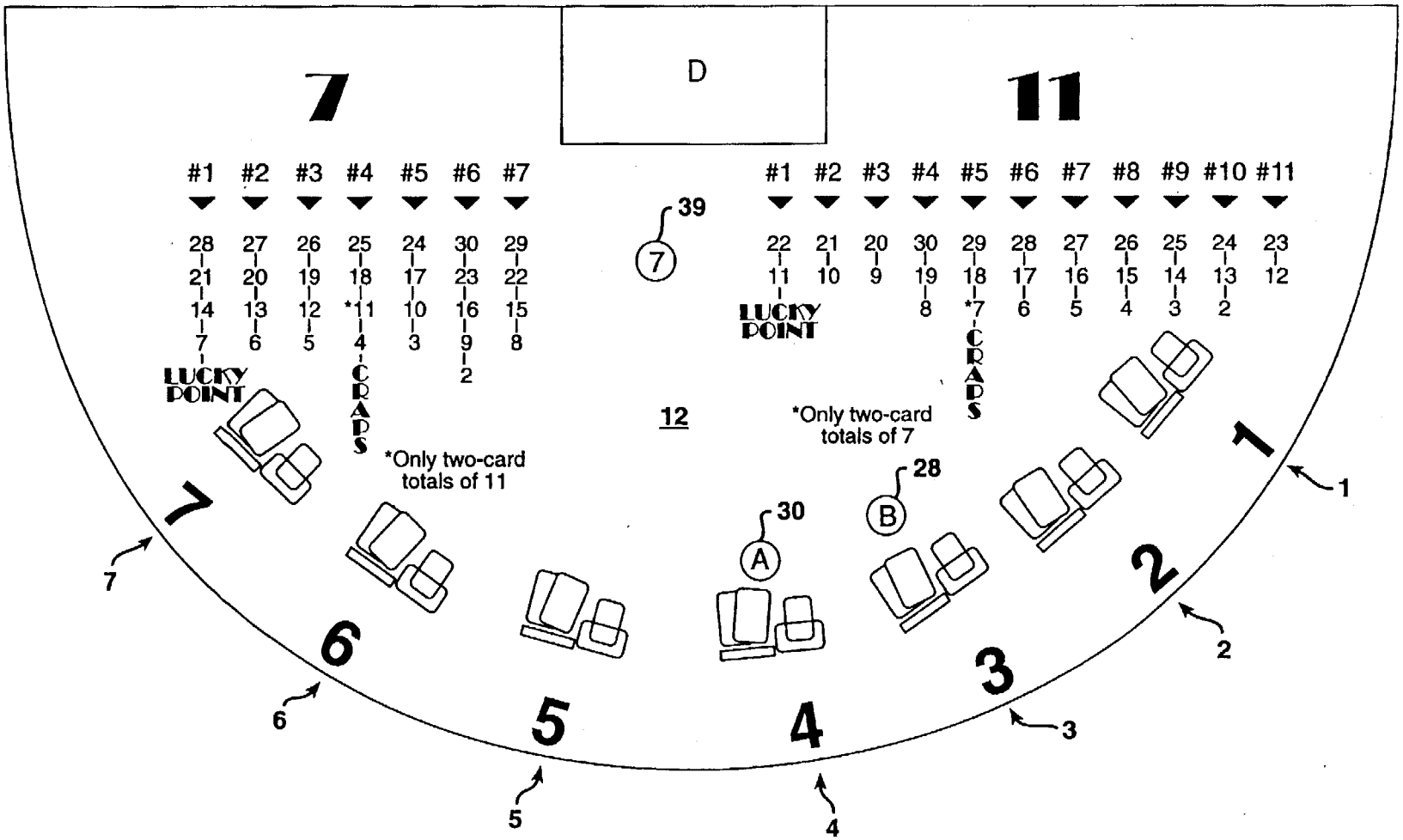
FIG. 1 illustrates a gaming table layout for use in play of the game of the invention and including a table layout with indicia helpful in rapidly ascertaining each player's hand value and hand rank.

FIG. 1 illustrates a casino or card club gaming table indicated generally at 10 having a fiat, felt-covered top surface 12 upon which seven player layouts, numbered one through seven are printed. The player layouts one through seven, except for their numerical positions indicated on the surface 12, are identical to each other. A single one of the player layouts is illustrated in enlarged form in FIG. 2. Chairs for seven players (not shown) are disposed about the periphery of the table 10, adjacent each of the player positions one through seven to accommodate seating of the players. It is to be understood, however, that eight, nine, or as many as eleven players can play the game at any one time at a table having an appropriate number of player positions. The game of the invention also employs a dealer who occupies the position indicated at D in FIG. 1. The dealer also normally sits during the course of the game.

The game of the invention is typically played with a multiplicity of playing cards shuffled together and packed in a casino or card club shoe. The cards are those utilized in a conventional deck of poker cards. In the preferred practice of the invention seven such decks of poker cards are utilized, but the eights and nines are removed from each deck. Thus, a total of forty-four cards are utilized from each deck to create a shoe having a total of three hundred eight cards. The object of the game is to acquire cards having a point count total equal to a target point count or a whole integer multiple of a target point count. In this connection each ace in the shoe has an assigned point count value of one, while the numerical cards each have a point count value indicated by the number thereon. All face cards, namely the jacks, queens, and kings, have a point count value of ten each.

Each of the player layouts one through seven is located on the playing surface 12 in a peripheral area of the gaming table 10. Each of the player layouts one through seven is identical, and a single one of the player layouts is depicted in detail through seven is identical, and a single one of the player layouts is depicted in detail in FIG. 2. As illustrated in that drawing figure each player layout includes an area to the left formed of a pair of overlapping, generally upright rectangles 18 and 20. Each of the rectangles 18 and 20 is slightly larger in size than the size of a conventional poker card. Beneath the upright rectangles 18 and 20 there is an elongated rectangular frame bearing the legend CRAPS "push", indicated at 22. To the right of the rectangles 18, 20, and 22 there is another rectangle 24, also slightly larger than the size of a poker card and oriented with its longest dimension extending transversely. The rectangle 24 bears the legend "Draw". Overlapping and extending above the rectangle 24 is another upright rectangle 26, also slightly larger than the size of a poker card, bearing the legend "Stand".

Figure 3A:
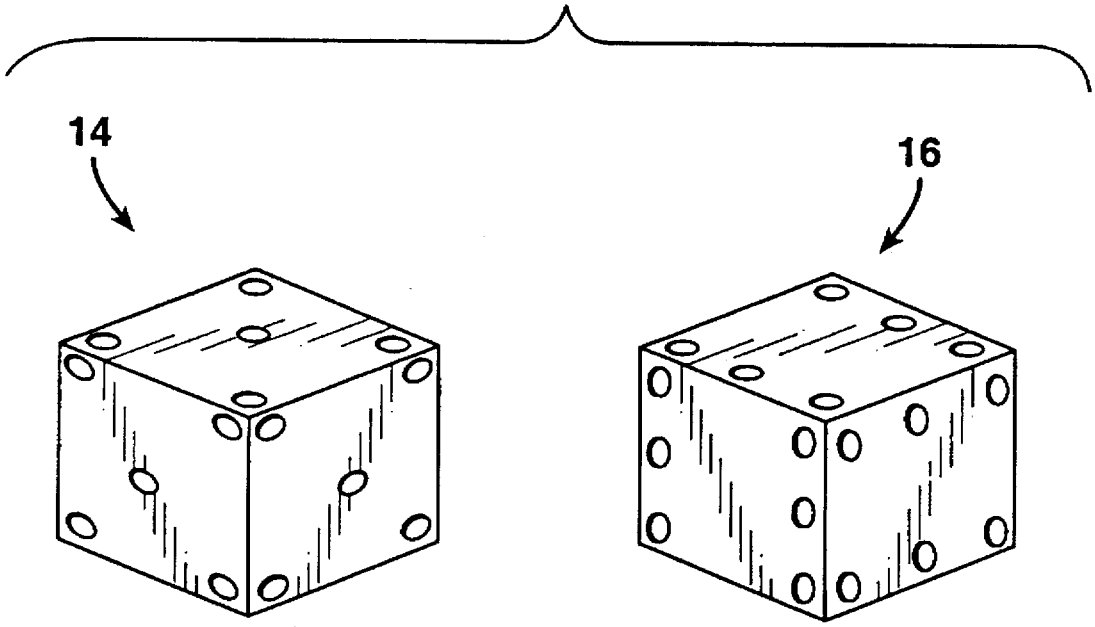
FIG. 3A is a perspective view from an elevated vantage point illustrating three faces of both dice in at least a first pair of dice provided according to the invention.
Figure 3B:
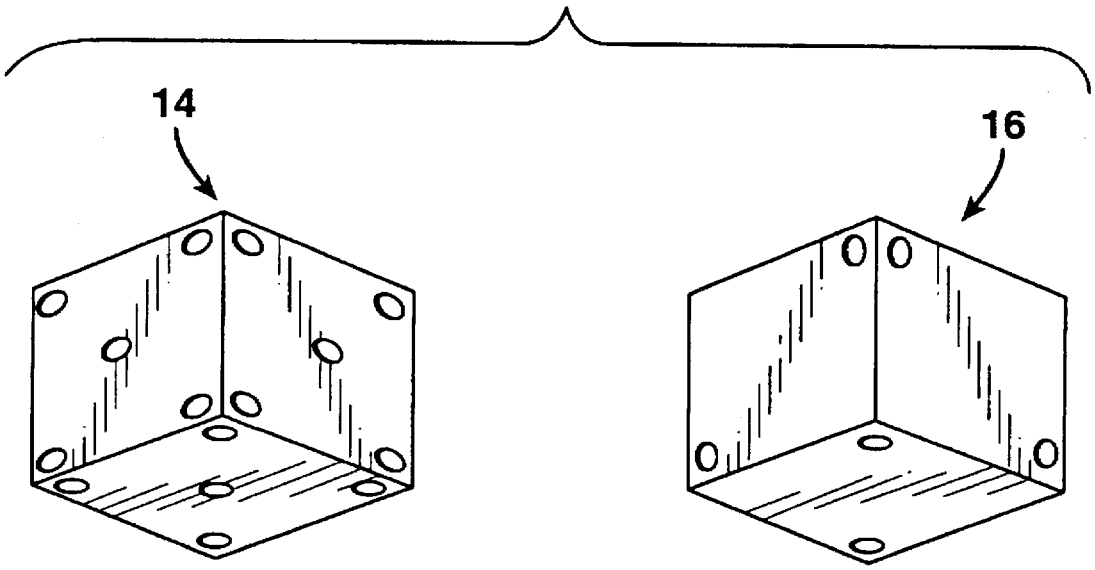
FIG. 3B is a perspective view of the dice of FIG. 3A from an opposite vantage point illustrating the other three faces of the first pair of dice.

The game of the invention also utilizes at least a first pair of special purpose dice, which are depicted in FIGS. 3A and 3B. These drawing figures are both perspective views of the same pair of dice, taken from opposite directions so as to depict all of the faces thereof.

Figure 2:
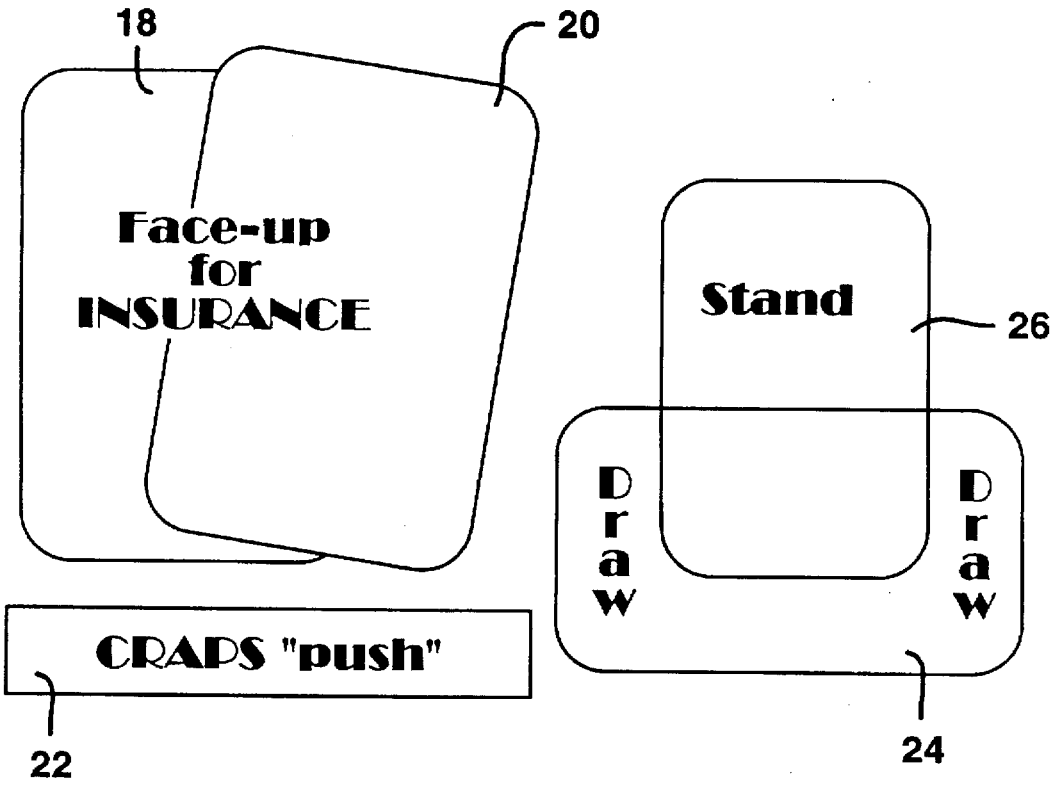
FIG. 2 is an enlarged detail of a single player position layout located in front of a single player position.

While the die 14 and the die 16 are each of the same size and cubical shape as conventional gambling dice, their faces are unique. Specifically, all of the faces of the die 14 bear 5 spots, as illustrated. The die 16, on the other hand, has 6 spots on three of its six faces, as illustrated in FIG. 3A, and 2 spots on the other three of its six faces, as illustrated in FIG. 3B.

Figure 4:
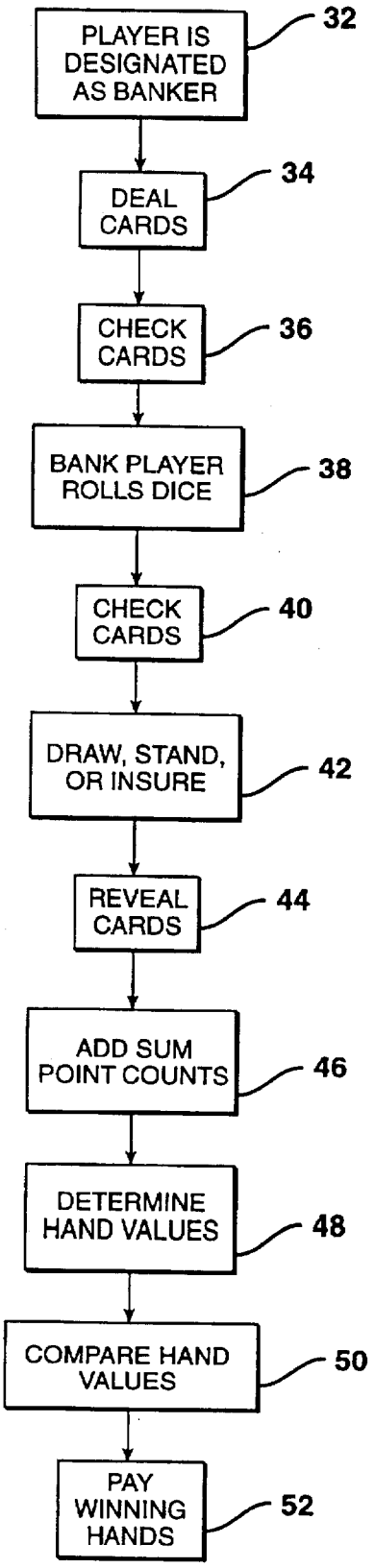
FIG. 4 is a flow diagram illustrating the steps performed in playing the game of the invention.

The sequence of play of the game is illustrated in FIG. 4 and may be best the player positions one through seven, shown in FIG. 1, while the nonwagering dealer participates in a supervisory and controlling capacity at the position D.

The dealer D shuffles the three hundred eight poker cards utilized in the game and places them in a shoe. One of the players must then be designated as a bank player, whereupon all the other players are thereupon considered to be nonbank players. The selection is typically made by offering the position of bank player to each player, proceeding clockwise from the position of the last player that has functioned as the bank player once that player relinquishes the bank player role. Once the bank player is selected, the object of play is for each nonbank player to achieve a total point count from cards dealt which is as close as possible to an optimum number. The dealer offers the role of bank player to each player at each of the player positions one through seven in sequence, commencing in a clockwise direction. Each player may alternatively accept the role of bank player or decline to do so, in which case the next player in clockwise sequence is offered that opportunity.

In the example, the players at player positions one and two decline the bank player position but the player at player position three accepts the role of bank player. A disc-shaped marker 28 bearing the letter "B" is thereupon positioned in front of the player at player position three, thus indicating to all concerned that player number three is the banker. The selection of the bank player is indicted as step 32 in FIG. 4. Another disc-shaped marker 30 bearing the character "A" is placed in front of the player at the next sequential clockwise position with respect to the bank player, namely the player at player position number four.

At the start of each game each of the nonbank players places a mandatory or required wager. Wagering may be in any amount between upper and lower limits posted for each table. All nonbank players must wager within posted table limits.

By way of example, at the start of the game players one, two, and four through eight each place a mandatory or required bet. The table 10 illustrated in FIG. 1 may be assumed to have wagering limits between ten and two hundred dollars. In most gambling establishments the collection amount is a fixed amount for a particular table. For example one dollar per wager. Therefore, in the example of play to be described player one places a wager of eleven dollars. The dealer takes one dollar of that amount and transfers it to a collection area for the establishment conducting the game. Player number two places a wager of twenty-one dollars at player number two's player position. The dealer collects one dollar of this amount and places it in the collection area.

Player number three is the bank player. Player number three must also pay a collection amount to the gaming establishment for each hand played. The dealer takes one dollar from player number three and places it in the collection area.

Player number four also places a wager of one hundred one dollars. One dollar of this amount is transferred to the collection area by the dealer for retention by the gaming establishment.

Players five through nine each place wagers of thirty-one dollars. One dollar of each of these amounts is transferred to the collection area for the gaming establishment.

The dealer D then deals a round of two cards, one at a time, all face down to each of the players. Dealing begins with player number four and continues in a clockwise manner twice time around the table. The last of the fourteen cards dealt face down is to player number three. The step of dealing the cards is indicated at 34 in FIG. 4.

At this point all of the nonbank players are at liberty to look at the cards they have been dealt. The step of checking their cards is indicated at 36 in FIG. 4. Bank player three, however, is prohibited by the rules of the game from checking his or her cards at this time. Rather, player number three thereupon rolls the dice 14 and 16 to determine a current target point count. Die 14 will display a five, regardless of which of its sides is disposed face up. In this example die 16, when rolled, comes to rest with one of the sides having two spots thereon facing upwardly. Thus, the sum total of the spots displayed on the pair of dice 14 and 17 is a total of seven. The number seven thereupon becomes the current target point count for this hand. The step of rolling the dice is indicated at 38 in FIG. 4. A disk shaped marker 39 is provided having the number 7 printed on one side and the number 11 printed on the other. The dealer D then places the marker 39 on the table 10 with the side displaying the number 7 facing upwardly.

Once the target point count of seven has been established, all of the players, except the bank player number three, look at the faces of their own cards to assess the values thereof toward achieving the target point count. This step of checking cards following the roll of the dice to establish the target point count is indicated at step 40 in FIG. 4. In this example the cards received by the players are indicated in Table 1.

TABLE 1

| Player | Card 1 | Card 2 |
|---|---|---|
| 1 | J | A |
| 2 | K | A |
| 3 | 7 | 4 |
| 4 | 10 | 3 |
| 5 | 6 | 3 |
| 6 | A | 4 |
| 7 | 4 | 5 |

Since all of the fourteen cards dealt to the players by the dealer are dealt face down, a player is able to see only his or her own cards. The players thereupon look at the faces of their own two cards to assess the values in making a point total as close as possible to seven or a whole integral multiple of seven, namely fourteen or twenty-one.

Having assessed their respective cards that are dealt on the first round, each nonbank player has the option of receiving a single additional card. Proceeding in a clockwise direction, beginning with the player position at which the Option/Action button 30 is located, namely player position number four, the dealer D inquires of each player as to whether or not that player wishes to receive a single additional card. The nonbank players at player positions one, five, six, and seven all elect to receive an additional card in the second round of dealing by placing their cards in the rectangle 24 in the player layout in front of them. Players numbers four and two elect not to receive any additional card. Player number 4 places his or her cards in the rectangle 26 in the player layout at player position number four.

Player number 2 was dealt a king and an ace, totaling eleven. Since the target point count is seven, not the alternative target point count eleven, player number two has a craps hand. In this example, player number two decides to forego any opportunity to attempt to improve the hand, and instead turns up the king and the ace onto the spaces 18 and 20 in the card layout at that player's position. Player number two is therefore in the position of being at a "push" with bank player number three, regardless of the cards that bank player number three ultimately receives. Player number two therefore neither receives any portion of the wager placed nor does player number two collect any portion of the wager placed from bank player number three. The step of electing to draw an additional card, stand pat, or insure a "push" when a player is dealt a craps hand is indicated at 42 in FIG. 4.

Table 2 lists the cards held by all players following the dealing of the additional card to those players that requested an additional card.

TABLE 2

| Player | Card 1 | Card 2 | Card 3 | Hand Value |
|---|---|---|---|---|
| 1 | J | A | 6 | 3 |
| 2 | K | A | X | push |
| 3 | 7 | 4 | 5 | 2 |
| 4 | 10 | 3 | X | 6 |
| 5 | 6 | 3 | 6 | 1 |
| 6 | A | 4 | 4 | 2 |
| 7 | 4 | 5 | 3 | 5 |

At this point all of the players reveal their cards, as indicated by step 44 in FIG. 4. The dealer D then adds the total sum point count of cards held by each player and subtracts therefrom the sum of all but one of any whole integer multiples of the current target point that are contained within the sum point count of cards held by each player. That is, if a player's sum point count exceeds the target point count of seven, seven points are subtracted from that player's sum point count to reach a hand value for that player. If the sum point count of a player exceeds the number fourteen, two times the target point count is subtracted from the sum point count of cards held by that player. In some cases the sum point count may exceed twenty-one, in which case three times the target point count of seven is subtracted from the sum point count in order to reach a hand value for a player. The step of adding the total sum point count of cards held by each player is indicated at 46 in FIG. 4. The step of subtracting whole integer multiples of the current target point count from the sum point count in order to reach a hand value for each player is indicated at 48 in FIG. 4.

The determination of the hand value for each player is facilitated by the layout on the table top 12 of the table 10 illustrated in FIG. 1. Since the target point count in the example is seven, only the left-hand portion of the table layout shown in FIG. 1 is applicable to this particular hand. If the pair of dice 14 and 16 had been rolled to produce a target point count of eleven, only the right-hand portion of the table layout illustrated in FIG. 1 would be utilized.

In the specific example of cards dealt indicated in FIG. 2, player number one had initially received a jack and an ace, which totalled eleven. This is a craps hand where the target point count is seven. Unlike player number two, however, player number one elected to attempt to improve his hand by drawing a third additional card. Player number one drew a six as the third and final card. As a consequence the sum point count of all of the cards held by player number one was seventeen (ten plus one plus six). This sum point count exceeds twice the target point count of seven, so that two times the target point count of seven, or fourteen, is subtracted from the total sum point count of seventeen in order to calculate the hand value of player number one. The hand value of the cards held by player number one is therefore three (seventeen minus fourteen) as indicated in Table 2. This hand value has a rank of five, as indicated in the table layout of FIG. 1.

As previously noted, player number two was also dealt a craps hand, but elected the "insurance" option of accepting a "push" with bank player number three.

Bank player number three was originally dealt a seven and a four. This was also a craps hand. However, player number three, as the bank player, has no option as to whether or not to participate in the final round of dealing, but instead was forced to accept a third card. That card was a five thereby giving bank player number three a total sum point count of sixteen. The sum point count exceeds the target point count by twice the number of the target point count (fourteen). Therefore, fourteen points are subtracted from the sum point count of cards held by player number three to reach the hand value of two for bank player number three. This hand value has a rank of six, as indicated in the table layout of FIG. 1.

Player number four was originally dealt a ten and a three, which totalled a card point count of thirteen. Since an even integer multiple, namely a multiple of one, times the current target point count of seven can be subtracted from the total sum point count of the initial two cards dealt to player number four, the hand value of the cards held by player number four at the end of the first round of dealing was six (thirteen minus seven). Observing that this hand ranked second of all possible hands, player number four elected not to receive any additional card in the second round of dealing.

Player number five was initially dealt a six and three, resulting in a sum point count of nine at the end of the first round of dealing as is evident from the table layout of FIG. 1. This hand value would have been two (nine minus seven) and would have had a rank of six. Player number five therefore elected to receive an additional card, which was a six. As a consequence, the sum point total of all cards held by player number five at the end of all dealing was fifteen. Since this number exceeds twice the number of the target point value, fourteen points are deducted from the total sum point count of the cards held by player number five, thus resulting in a hand value of one. This hand value ranks seventh, which is the last among the possible hand values for a target point count of seven.

Player number six was initially dealt an ace and an four in the first round of dealing, thus producing a total sum point count of five at the end of that round. Since this total sum point count does not exceed the target point count of seven, no points are subtracted from the cards dealt to player number six in the first round in order to determine the hand value for player number six at the end of that round. That is, at the end of the first round of dealing player number six had a hand value of five, which ranked third in the range of possible hand values where the target point count is seven, as indicated in the table layout of FIG. 1. Even so, player number six attempted to improve his hand even further by electing to receive a third card. That card was a four, thus giving player number six a final total sum point count of 9 (one plus four plus four). This total sum point exceeds the target point count of seven so that seven points are subtracted from the total sum point count for player number six, thus resulting in a hand value of two (one plus four plus four minus seven). This hand value ranks sixth in the range of possible hand values for a target point count of seven.

Player number seven was initially dealt a four and a five, thus resulting in a total sum point count of nine at the end of the first round of dealing. Subtracting seven from this amount left player number seven with a hand value of two at the end of the first round of dealing. Seeking to improve his hand, player number seven elected to receive an additional card. This card was a three. As a consequence, the total sum point count of all cards held by player number seven at the end of the hand was twelve. This total sum point exceeded the target point count by one times the target point count of seven, so that seven points were deducted from the total sum point count of cards held by player number seven, thus resulting in a hand value of five (four plus five plus three minus seven). This hand value ranks third among the hand values possible for a target point count of seven.

Once all hand values are determined bank player number three must pay all winning nonbank players in the amounts of their respective wagers, less the one dollar portion previously collected for the benefit of the gaming establishment. Also, bank player number three at this time collects from losing nonbank players the amounts of their respective wagers less the one dollar portion thereof previously collected for the benefit of the gaming establishment.

In the specific example given, players numbers four and seven both had a hand value of six, with a hand rank of two. This exceeds the rank of the hand value of two held by bank player number three, which ranked sixth out of the seven possible rankings. Therefore, bank player number three must pay nonbank players numbers four and seven the wagers of one hundred dollars and thirty dollars, respectively, which they made.

Also, the rank of the hand value of nonbank player number one exceeds that of bank player number three since nonbank player number one has a hand value of three with a rank of five. This is superior to the hand value of two of bank player number three, having a rank of six, so that bank player number three must also pay nonbank player number one the amount of ten dollars.

Player number two, having had been dealt a craps hand and electing the insurance option automatically is at a "push" with bank player number three regardless of the ranking of their respective hands. Consequently, bank player number three neither pays nor collects any wager with respect to player number two.

Nonbank player number six and bank player number three both have a hand value of two. Therefore, a "push" also exists between bank player number three and nonbank player number six. No wager changes hands between them.

Nonbank player number five had a hand value of one, which ranks seventh or last out of all possible values for a target point count of seven. Therefore, the hand value of two of bank player number three is superior to that of nonbank player number five. Consequently, bank player number three collects the wager of thirty dollars from nonbank player number five. The step of paying the winning hands is indicated at 52 in FIG. 4. At this point the hand has been completed and a new hand is dealt.

Some further specific examples are further illustrative of the results of play according to the invention.

If the player's hand is jack, two, and seven totaling 19, and the target point count is eleven, the first eleven is equal to zero and the remaining point count is eight (nineteen minus eleven equals eight. Eight is the hand value of the player's hand, which ranks fourth out of the eleven possible hand values for a target point count of eleven. This is indicated in the right-hand side of the table layout of FIG. 1.

If the player's hand is seven, five, and king totaling twenty-two, and the target point count is eleven, the first eleven is equal to zero and the remaining hand value is eleven (seven plus five plus ten minus eleven). Eleven is the hand value of the player's hand, which ranks first and may be considered to be the "Lucky Point".

If the current target point count is seven, and the player's hand is three, seven and ace totaling eleven, the first seven is equal to zero and the remaining count is four (three plus seven plus one minus seven). The player's hand value is four.

If the player's hand is seven, six, and seven totalling twenty, and the target point count is eleven, the first eleven is equal to zero and the remaining sum value is nine (seven plus six plus seven minus eleven). The player's hand value is nine, which has a rank of three.

If the current target point count is seven and the player's hand is ace, three and queen totaling fourteen, the first seven is equal to zero and the remaining point count is seven (one plus three plus ten minus seven). The player's hand value is seven, which is the best possible rank.

If the player's hand is ace, two, and king totalling thirteen and the current target point total is eleven, the card sum total exceeds the target point total so eleven is subtracted from the card sum total leaving the player a hand value of two (one plus two plus ten minus eleven).

If the current target point total is seven and the player's hand is ace, three and six totaling ten, the target point total is deducted from the card sum total leaving the player a hand value of three (one plus three plus six minus seven).

If the player's hand consists of three, five, and jack totalling eighteen, and the current target point total is eleven, eleven is subtracted from the total card sum of eighteen which leaves the player's hand with a value of seven (three plus five plus ten minus eleven).

When the player's hand consists of six, king, and five totalling twenty-one and the current target point count is eleven, the total card sum of twenty-one is reduced by eleven (six plus ten plus five minus eleven) and the player's hand has a hand value of ten. This hand value ranks second only to a hand have a total point count of eleven or twenty-two when the optimum or target point count is eleven.

If the players hand consists of three, four, and queen for a total card sum of seventeen and the target point count is eleven, the total card sum of seventeen is reduced by eleven which leaves the player's hand with a hand value of six (three plus four plus ten minus eleven).

When the target point count is eleven and the player's hand is comprised of five, two, and five for a card total sum of twelve, the player's total sum point count exceeds the current target point count of eleven. The total card sum is reduced by eleven which leaves the player's hand with a hand value of one (five plus two plus five minus eleven).

If the player's hand is made up on ace, six, and seven for a total of fourteen and the target point count is eleven, to determine the player's hand value eleven must be subtracted from fourteen leaving the player with a hand value of three (one plus six plus seven minus eleven).

When the target point count is eleven and the player's hand consists of two, three, and jack for a total of fifteen, the player's total card sum of fifteen is reduced by the target point count of eleven to leave the player's hand with a hand value of four (two plus three plus ten minus eleven).

The player is left with a hand value of five when the target point count is eleven and the player's hand consists of three, three, and ten (three plus three plus ten minus eleven).

If the target point count is eleven and the player's hand is comprised of five and six which totals eleven, then the player has achieved the optimum or target point count. If, however, the target point count is seven with this hand, the player has a craps hand.

If the target point count is eleven and the player's hand consists of seven and four for a total of eleven, the player has achieved the optimum or target point count. If, however, the target point count is seven with this hand, the player has a craps hand.

The player achieves the optimum or target point count if the player's hand consists of ace and ten with a target point count of eleven. The player has a craps hand with the same cards, however, if the target point count is seven.

The player achieves the optimum or target point count with a hand comprised of queen and ace when the target point count is eleven. However, the player has a craps hand with the same cards if the target point count is seven.

If the target point count is seven and the player's hand is comprised of six and ace which totals seven, then the player has achieved the optimum or target point count. If, however, the target point count is eleven with these cards, the player has a craps hand.

If the target point count is seven and the player's hand consists of five and two for a total of seven, the player has achieved the optimum or target point count. If, however, the target point count is eleven with this hand, the player has a craps hand.

The player achieves the optimum or target point count with a hand consisting of three and four for a total of seven with a target point count of seven. The player has a craps hand with these same cards, however, if the target point count is eleven.

The player achieves the optimum or target point count with a hand comprised of seven and seven for a total of fourteen when the target point count is seven since only one amount of seven is subtracted. However, if the target point count is eleven the player has a hand value of three (seven plus seven minus eleven).

When the target point count is seven and the player is dealt either a king, queen, jack, or ten as a first card and four as a second card for a total of fourteen points, the player has achieved the optimum or target point count (ten plus four minus seven). If the target point count is eleven, on the other hand, then the player has hand value of three with these same cards.

If the player's hand consists of king, seven, and jack for a total of twenty-seven and the target point count is eleven, then twice the target point count or twenty-two is deducted from the card total sum. This leaves the player with a hand value of five.

If the target point count is seven and the player's hand is comprised of five, five, and queen which has a total of twenty, twice the target point count or fourteen is subtracted from the total card sum of twenty. The player is left with a hand value of six.

When the player's hand consists of jack, six, and seven, for a total of twenty-three and the target point count is eleven, the final hand value is one (ten plus six plus seven minus twenty-two, which leaves a hand value of one).

Figure 5A:
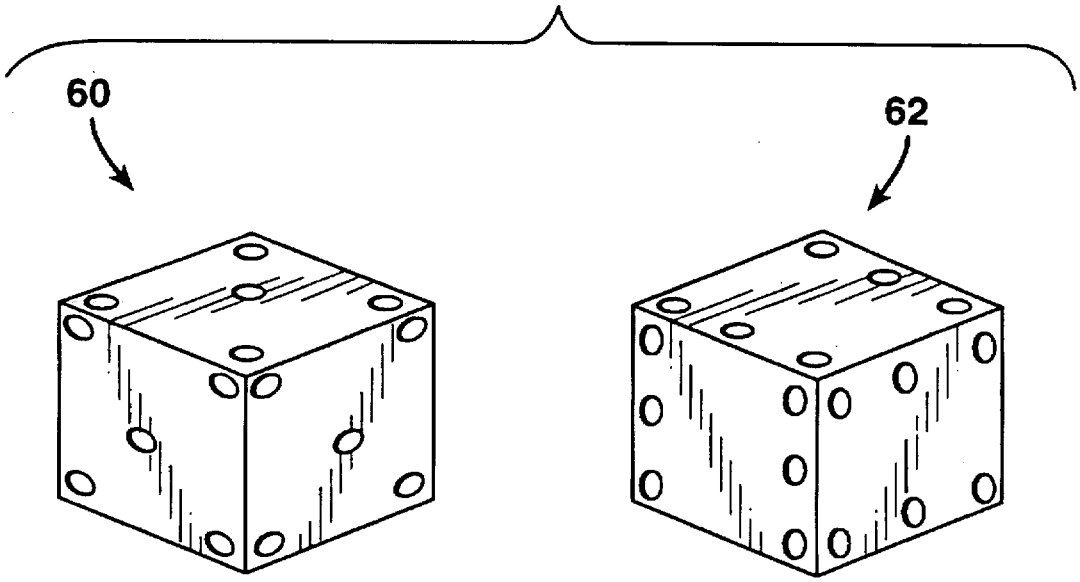
FIG. 5A is a perspective view from an elevated vantage point illustrating three faces of both dice in a second pair of dice provided according to the invention.
Figure 5B:
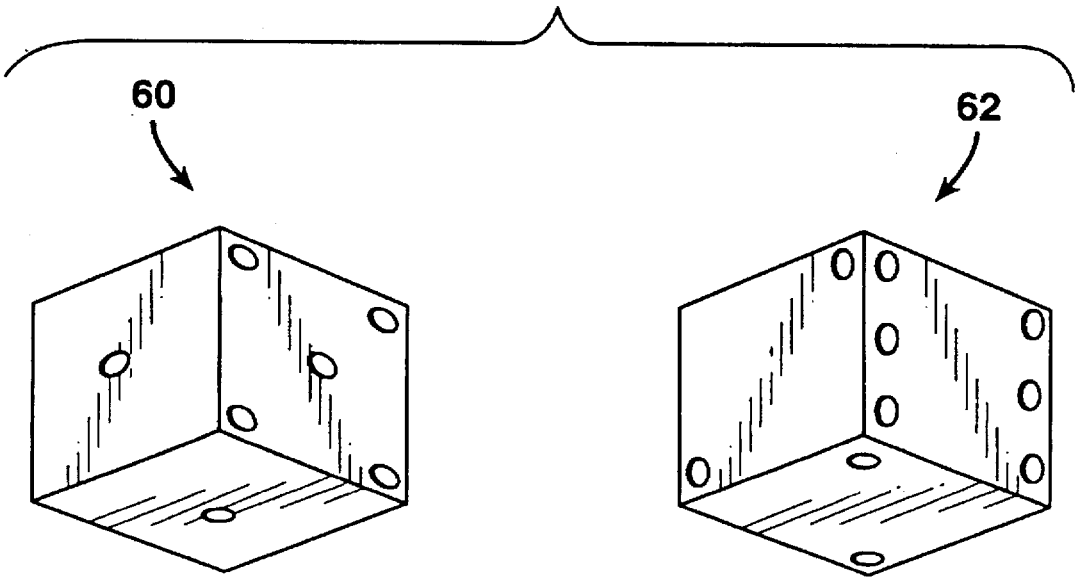
FIG. 5B is a perspective view of the dice of FIG. 5A from an opposite vantage point illustrating the other three faces of the second pair of dice.

In a further modification of the invention a second pair of dice 60 and 62 maybe employed. These dice are illustrated in FIGS. 5A and 58. As shown in those drawing figures, the die 60 has a count of five spots on four of its faces and a single spot on its other two faces. The other die 62 has six spots on four of its faces and two spots on the other two of its faces. As a consequence, the dice 60 and 62, when thrown together, will always display the number seven, eleven, or three.

In a modification of the game employing the second set of dice 60 and 62, seven poker decks of fifty-two cards each are provided. In this version of the game none of the cards are removed. There will therefore be a total of three hundred sixty-four cards which are shuffled and placed in a shoe, which may be termed a "short shoe". Alternatively, eleven such decks may be employed to create and extended shoe of five hundred seventy-four cards.

As in the other embodiment, a dealer is provided to collect a predetermined amount of each wager and to declare winners from among the players. Again, one of the players is selected as a bank player, all of the other players thereupon becoming nonbank players. One of the nonbank players is selected as a starting position player.

The dealer then deals a first round of two cards face down to each of the players in rotation beginning with the starting position player. The bank player thereupon rolls the second set of dice 60 and 62 to determine a current target point count if the dice 60 and 62 display a count of seven or eleven, play proceeds as previously described. If, on the other hand, the dice 60 and 62 display a count of three, any nonbank player whose first cards are an ace and a deuce has the option of playing the had as a craps hand, which results in a "push". A player making such an election thereupon places his ace and deuce face up in the positions 18 and 20 of the card layout at his or her player position. That player will thereafter neither collect from nor pay to the bank player any portion of the amount wagered. On the other hand, if a nonbank player is dealt a craps hand that player may alternatively elect to receive a third card.

If the roll of the dice 60 and 62 produces a three, the bank player has the election, before looking at his cards, of declaring either the number seven or the number eleven as the current target point count. Play thereafter proceeds as previously described. Alternatively, the bank player may prefer to make the selection of a current target point count by throwing the other pair of dice 14 and 16. In both cases a target point count of seven or eleven is assured and play proceeds as previously described. However, the target point count is selected, the bank player has the option of receiving up to two additional cards.

Undoubtedly, numerous variations and modifications of the invention will become readily apparent to those familiar with the conduct of games of chance. For example, while dice totaling seven or eleven or dice totaling three, seven, or eleven are utilized in the preferred embodiments of the invention, dice having other point counts could be utilized as well. Indeed, the game could even be played with standard gaming dice having a different number between one and six spots on each of their faces. The reason for utilizing the special purpose dice with only a limited number of possible target point counts is to simplify the game. Nevertheless, the same principal of play can be employed regardless of the dice configuration.

Accordingly, the present invention should not be considered to limited to the specific examples recited herein.

I claim:

1. A method of playing a card and dice game among a plurality of nonbank players playing against a single bank player with the ultimate game objective of achieving a variable target point count comprising the steps of:

providing a set of cubical gambling dice;

providing at least one poker deck of a multiplicity of cards having different point values of between 1 and 10 inclusive, wherein each of said cards has a specific one of said point values;

placing a required wager within predetermined upper and lower limits by each of said players;

providing a dealer to collect a predetermined amount of each wager, to deal said cards, and to declare winners from among said players;

selecting one of said players as a bank player for each hand, all other of said players thereupon becoming nonbank players;

collecting by said dealer of said predetermined amount of said required wager from each player;

selecting one of said nonbank players as a starting position player;

dealing by said dealer of a first round of two cards face down to each of said players in rotation beginning with said starting position player;

throwing said dice to determine a current target point count, whereupon said players look at the faces of their own cards to assess the values thereof toward achieving said target point count;

determining by each player whether to draw a single additional card;

dealing by said dealer a second round of cards of no more than a single additional card each to those players in rotation that request a single additional card;

turning over all face down cards of each player;

adding of the total sum point count of cards held by each player;

comparing the total sum point count of cards held by each player with said current target point count, and iteratively subtracting said target point count from the total sum point count of cards held by each player until a number no greater than said current target point count is reached, which number is then designated as the player's hand value;

comparing the hand value of cards held by each nonbank player with the hand value of cards held by said bank player;

declaring by said dealer as winning nonbank players all nonbank players whose hand values exceed the hand value of said bank player, and declaring by said dealer as losing nonbank players all nonbank players whose hand values are less than the hand value of said bank player; and paying by said bank player to winning nonbank players their respective wagers less the aforesaid predetermined amounts thereof and collecting by said bank player from losing nonbank players their respective wagers less the aforesaid predetermined amount thereof.

2. A method according to claim 1 wherein all nonbank players whose hand values are equal to that of said bank player are neither winning nor losing players and are neither paid nor collect their respective wagers less the aforesaid predetermined amount thereof.

3. A method according to claim 2 further comprising providing a plurality of poker decks as aforesaid, and removing from them all the 8's and 9's prior to dealing, and assigning all face cards a point value of ten and aces a point value of one.

4. A method according to claim 2 further comprising configuring said gambling dice so as to display alternatively spots totaling only one of the numbers 7 and 11 as said current target point count.

5. A method according to claim 4 further comprising providing to all nonbank players who are initially dealt cards having a total point value equal to the other of said numbers 7 and 11 that is not the current target point count with the additional option of having their hands treated as having a hand value equal to that ultimately attained by said bank player, provided they relinquish their rights to receive a single additional card.

6. A method according to claim 4 further comprising forcing said bank player to receive a single additional card if said bank player is initially dealt cards having a total point value equal to the other of said numbers 7 and 11 that is not the current target point.

7. A method according to claim 2 further comprising providing a plurality of poker decks as aforesaid and assigning all face cards a point value of ten and aces a point value of one, and configuring said gambling dice so as to display alternatively a single one of the numbers 3, 7, and 11 for determining said current target point count, and wherein when said dice are thrown to display a 3, providing said bank player with the option of selecting said current target point count from among the numbers 7 and 11 and throwing an alternative set of gambling dice configured so as to produce alternatively a single one of the numbers 7 and 11 as said current target point count.

8. A method according to claim 7 further comprising providing all nonbank players who are initially dealt cards having a total point count value equal to 3 with the option of having their hands treated as having a hand value equal to that ultimately attained by said bank player, provided they relinquish their rights to receive an additional card.

9. A method according to claim 2 further comprising a plurality of poker decks as aforesaid and assigning to all face cards a point value of ten and aces a point value of one, and configuring said gambling dice so as to display alternatively a single one of the numbers 3, 7, and 11 for determining said current target point count, and wherein when said dice are thrown to display a 3, providing said bank player with the option of receiving up to two additional cards.

10. A method of playing a card and dice game among a plurality of nonbank players playing against a single bank player with the ultimate game objective of achieving a variable target point count without exceeding said target point count comprising the steps of:

providing a pair of cubical gambling dice;

providing at least one poker deck of a multiplicity of cards having different point values of between 1 and 10 conclusive, wherein each of said cards has a specific one of said point values;

placing a required wager within predetermined upper and lower limits by each of said players;

providing a dealer to collect a predetermined amount of each wager, to deal said cards, and to declare winners from among said players;

selecting from among said players a single player to act as a bank player, all of said other players thereupon becoming nonbank players;

collecting by said dealer of said predetermined amount of said required wager from each player;

selecting one of said nonbank players as a starting position player;

dealing by said dealer of a first round of two cards face down to each of said players in rotation beginning with said starting position player;

throwing said dice to determine a current target point count, whereupon said players look at the faces of their own cards to assess the values thereof toward achieving said target point count;

determining by each player whether to draw a single additional card;

dealing by said dealer a second round of cards of no more than a single additional card to each player in rotation that requests a single additional card;

turning over all face down cards of each player;

adding of the total sum point count of cards held by each player;

subtracting from the total sum point count of cards held by each player the sum of all but one of any whole integer multiples of said current target point that are contained within the total sum point of cards held by each player so as to reach a hand value for each player;

comparing of the hand value of cards held by each nonbank player with the hand value of cards held by said bank player;

declaring by said dealer as winning nonbank players all nonbank players whose hand values exceed the hand value of said bank player, and declaring by said dealer as losing nonbank players all nonbank players whose hand values are less than the hand value of said bank player; and paying by said bank player to winning nonbank players the amounts of their respective wagers less the aforesaid predetermined amount thereof and collecting by said bank player from losing nonbank players the amounts of their respective wagers less the aforesaid predetermined amount thereof.

11. A method according to claim 10 further comprising declaring as push players each nonbank player whose hand value is equal to that of said bank player, whereupon all push players neither win nor lose and neither collect nor receive any amounts from said bank player.

12. A method according to claim 11 further comprising providing a plurality of poker decks as aforesaid, and removing therefrom all 8's and 9's prior to dealing, and assigning all face cards a point count value of ten, all aces a point count value of one, and all other cards a point count value equal to numerical indicia printer thereon.

13. A method according to claim 12 further comprising providing at least seven poker decks with cards removed as aforesaid.

14. A method according to claim 12 further comprising providing a plurality of poker decks as aforesaid, and configuring said gambling dice so as to display alternatively spots totaling only a single one of the numbers 3, 7, and 11, and wherein the numbers 7 and 11 alternatively become said target point count when displayed and when the number 3 is displayed, providing said bank player with the option of declaring a single one of the numbers 7 and 11 as said target point count and alternatively throwing a different set of dice configured to display alternatively spots totalling only one of the numbers 7 and 11, which when displayed become said target point count.

15. A method of playing a combination card and dice game among a plurality of players comprising the steps of:

a) providing at least one deck of playing cards each card having a specified point value of no less than one and no greater than ten, b) selecting a player to act as a banker, whereupon all other players are deemed to be nonbank players, c) providing a set of dice, each die having a plurality of faces and each face bears a specific count indicia, and wherein the aggregate count appearing on said set of dice when said dice are thrown is limited to specific predetermined alternative dice count totals, d) dealing a hand of two cards face down to all players, e) rolling said set of dice, f) declaring the indicia count total appearing on said set of dice as an optimum value for the current hand, g) assessing by each player of the total card point count of cards currently held, h) electing by each player, in turn, a single one of the options of alternatively receiving and foregoing receipt of a single additional card, which if received becomes part of the current hand, and dealing a single additional card to those players that elect to receive one, i) determining the total point count of cards in each player's hand and subtracting therefrom integer multiples of said optimum value until the remaining point count of each player's hand is a residual number greater than zero and no greater than said optimum value, which residual number becomes the hand value for each player's hand, j) comparing each nonbank player's hand value with the hand value of said banker, and k) declaring as winning nonbank players all nonbank players whose hand value is greater than the hand value of said banker and as losing nonbank players all nonbank players whose hand value is less than the hand value of said banker.

16. A method according to claim 15 further comprising indicating said optimum value to all players with a corresponding optimum value button.

17. A method according to claim 15 further comprising indicating said bank player to all players with a banker indicia button.

* * * * *